US011718902B2

(12) United States Patent
Wang et al.

(10) Patent No.: US 11,718,902 B2
(45) Date of Patent: Aug. 8, 2023

(54) RARE EARTH DIE STEEL AND PREPARATION METHOD THEREOF

(71) Applicants: Jiangxi University of Science and Technology, Ganzhou (CN); Guorui Scientific Innovation Rare Earth Functional Materials (Ganzhou) Co., Ltd, Ganzhou (CN)

(72) Inventors: Zhigang Wang, Ganzhou (CN); Liang Qi, Ganzhou (CN); Hebin Wang, Ganzhou (CN); Jieyun Ye, Ganzhou (CN); Weihao Cai, Ganzhou (CN); Xuwei Liu, Ganzhou (CN)

(73) Assignees: Jiangxi University of Science and Technology, Ganzhou (CN); Guorui Scientific Innovation Rare Earth Functional, Ganzhou (CL)

( * ) Notice: Subject to any disclaimer, the term of this patent is extended or adjusted under 35 U.S.C. 154(b) by 0 days.

(21) Appl. No.: 17/671,147

(22) Filed: Feb. 14, 2022

(65) Prior Publication Data

US 2023/0100153 A1 Mar. 30, 2023

(30) Foreign Application Priority Data

Sep. 24, 2021 (CN) ..... 202111119239.7

(51) Int. Cl.
*C22C 38/04* (2006.01)
*C22C 38/00* (2006.01)
*C21D 8/00* (2006.01)

(52) U.S. Cl.
CPC ..... *C22C 38/04* (2013.01); *C21D 8/005* (2013.01); *C22C 38/005* (2013.01)

(58) Field of Classification Search
None
See application file for complete search history.

(56) References Cited

FOREIGN PATENT DOCUMENTS

CN 103243268 A * 8/2013

* cited by examiner

*Primary Examiner* — Anthony M Liang
(74) *Attorney, Agent, or Firm* — Andrea Arndt; Dickinson Wright, PLLC

(57) ABSTRACT

The present disclosure provides rare earth die steel. Mg and B elements are added on the basis of adding rare earth element Y, so that the rare earth element purifies a matrix, and grain boundary occupation by Mg and B is fully utilized to regulate grain network chromium carbides. In addition, the B element can fully improve hardenability of austenite and ensure that non-martensite such as bainite does not appear during the cooling process, and therefore rare earth die steel with high impact toughness and high isotropy is obtained.

9 Claims, 3 Drawing Sheets

RARE EARTH DIE STEEL AND PREPARATION METHOD THEREOF

CROSS REFERENCE TO RELATED APPLICATION

This patent application claims the benefit and priority of Chinese Patent Application No. 202111119239.7 filed on Sep. 24, 2021, the disclosure of which is incorporated by reference herein in its entirety as part of the present application.

TECHNICAL FIELD

The present disclosure relates to the field of die steel technology, and in particular, to a rare earth die steel and a preparation method thereof.

BACKGROUND ART

Hot working die steel has high strength and good wear resistance, and is widely used in hammer forging dies, hot extrusion dies, die-casting dies and other dies. However, a certain gap still exists between current domestic hot working die steel and foreign products in impact toughness, isotropy and the matching of hardness and thermal fatigue properties, and adjustment of the billet structure of the hot working die steel before die sinking is crucial to the die properties. Therefore, the preparation of hot working die steel that can meet requirements of the North American Die Casting Association standard (NADCA#207-2016) for the band structure and carbide segregation of annealed die steel is expected to narrow the gap between domestic hot working die steel and foreign products.

Alloying elements in the hot working die steel mainly include chromium, molybdenum, and vanadium, which form various alloy carbides with iron, carbon, and nitrogen during the solidification process. Due to higher energy at a grain boundary position, the elements tend to preferentially become carbide nuclei. This leads to the generation of segregation of network carbides, and the matching of the strength and toughness of hot working die steel mainly depends on the size, type and distribution of carbides. The band segregation of chromium-rich brittle primary carbides at a grain boundary is one of the main reasons for cracking of hot working die steel. To improve the distribution of this kind of carbides in the hot working die steel and improve impact toughness and isotropy of hot working die steel, the patents No. CN1088629A, No. CN101709428A, and No. CN103243268A teach that rare earth elements are added to hot working die steel to purify a matrix and improve the distribution of carbides at a grain boundary. However, an atomic radius difference between rare earth elements and iron element makes the rare earth elements play a limited role in microalloying, especially in controlling the phase change in the cooling process and inhibiting the non-martensite structure, which makes it impossible to obtain rare earth die steel with high impact toughness and high isotropy.

SUMMARY

An objective of the present disclosure is to provide a rare earth die steel and a preparation method thereof. The rare earth die steel according to the present disclosure has high impact toughness and high isotropy.

To achieve the foregoing invention objective, the present disclosure provides the following technical solution:

The present disclosure provides a rare earth die steel, including, by mass percentage, the following components: 0.36%-0.41% of C, 0.80%-1.10% of Si, 0.30%-0.50% of Mn, 4.90%-5.40% of Cr, 1.35%-1.55% of Mo, 0.8%-1.1% of V, 0.001%-0.005% of B, 0.006%-0.01% of Y, 0.001%-0.005% of Mg, no more than 0.003% of S, no more than 0.012% of P, no more than 0.0015% of O, less than 0.005% of H, and the balance of Fe, where $0.01\%<Y+Mg<0.02\%$.

Preferably, the rare earth die steel includes, by mass percentage, 0.39%-0.41% of C, 0.85%-0.95% of Si, 0.38%-0.45% of Mn, 4.98%-5.30% of Cr, 1.48%-1.52% of Mo, 0.89%-0.95% of V, 0.002%-0.004% of B, 0.007%-0.009% of Y, 0.003%-0.004% of Mg, no more than 0.003% of S, no more than 0.012% of P, no more than 0.0015% of O, less than 0.005% of H, and the balance of Fe, where $0.01\%<Y+Mg<0.02\%$.

Preferably, a band segregation degree of the rare earth die steel is level As1, and grades of A, B, C, D, and Ds inclusions in the rare earth die steel are less than or equal to level 1.

The present disclosure further provides a method for preparing the rare earth die steel in the foregoing technical solution, including converter smelting, LF secondary refining, VD refining treatment, casting, electroslag remelting, homogenization treatment, hot forging, and heat treatment performed in sequence.

Preferably, Y and Mg are added in the VD refining treatment process, and Y and Mg are added in the form of an yttrium-magnesium master alloy; a mass content of Y in the yttrium-magnesium master alloy is 30%, and a mass content of Mg is 70%; and a solid dissolved oxygen content of the yttrium-magnesium master alloy is less than or equal to 0.005%.

Preferably, the yttrium-magnesium master alloy is added in the form of an alloy wire; a diameter of the yttrium-magnesium master alloy wire is 3-6 mm; and a wire feeding rate of the yttrium-magnesium master alloy wire is 2-4 m/s.

Preferably, the yttrium-magnesium master alloy wire is fed under an argon atmosphere; a flow rate of argon is 80-100 L/min during the wire feeding and 50-80 L/min after the wire feeding is completed; and an argon blowing treatment is used throughout the VD refining treatment.

Preferably, a cooling process after the hot forging specifically includes: air-cooling to 650-750° C. and then water-cooling for 4-6 min, then air-cooling to 400-450° C. and then water-cooling for 4-6 min, and finally air-cooling to room temperature.

Preferably, the heat treatment includes a primary heat treatment and a secondary heat treatment;

the primary heat treatment includes: heating a forging billet obtained from the hot forging to 650-750° C. and keeping at the temperature for 1-2 h, then heating to 1060-1080° C. and keeping at the temperature for 6-8 h, then air-cooling to 840-860° C., then water-cooling for 4-6 min, then air-cooling for 4-6 min, then water-cooling for 3-5 min, then air-cooling to 350-450° C., and finally oil-cooling to room temperature; and the secondary heat treatment includes: performing compression deformation on the rare earth die steel after the primary heat treatment, then keeping at 800-900° C. for 8-10 h, then cooling to 740-760° C. and keeping at the temperature for 9-11 h, then furnace-cooling to 500-600° C., and oil-cooling to room temperature.

Preferably, a deformation amount of the compression deformation is 5-10%.

The present disclosure provides rare earth die steel, including, by mass percentage, the following components: 0.36%-0.41% of C, 0.80%-1.10% of Si, 0.30%-0.50% of Mn, 4.90%-5.40% of Cr, 1.35%-1.55% of Mo, 0.8%-1.1% of V, 0.001%-0.005% of B, 0.006%-0.01% of Y, 0.001%-0.005% of Mg, no more than 0.003% of S, no more than 0.012% of P, no more than 0.0015% of O, less than 0.005% of H, and the balance Fe, where 0.01%<Y+Mg<0.02%. In the present disclosure, Mg and B elements are added on the basis of adding the rare earth element Y, which exerts a purification of the rare earth element, and at the same time fully utilizes the grain boundary occupation by Mg and B, thus regulating grain network chromium carbides. In addition, the B element can fully improve the hardenability of austenite and ensure that non-martensite such as bainite does not appear during the cooling process, thus obtaining rare earth die steel with high impact toughness and high isotropy. Results of embodiments show that, in the present disclosure, the band segregation degree of the rare earth die steel is As1, the inclusion level is level 1, the longitudinal impact energy is 16.2 J, the transverse impact energy is 14.4 J, and the isotropy is 0.88.

DETAILED DESCRIPTION OF THE EMBODIMENTS

Figure 1:
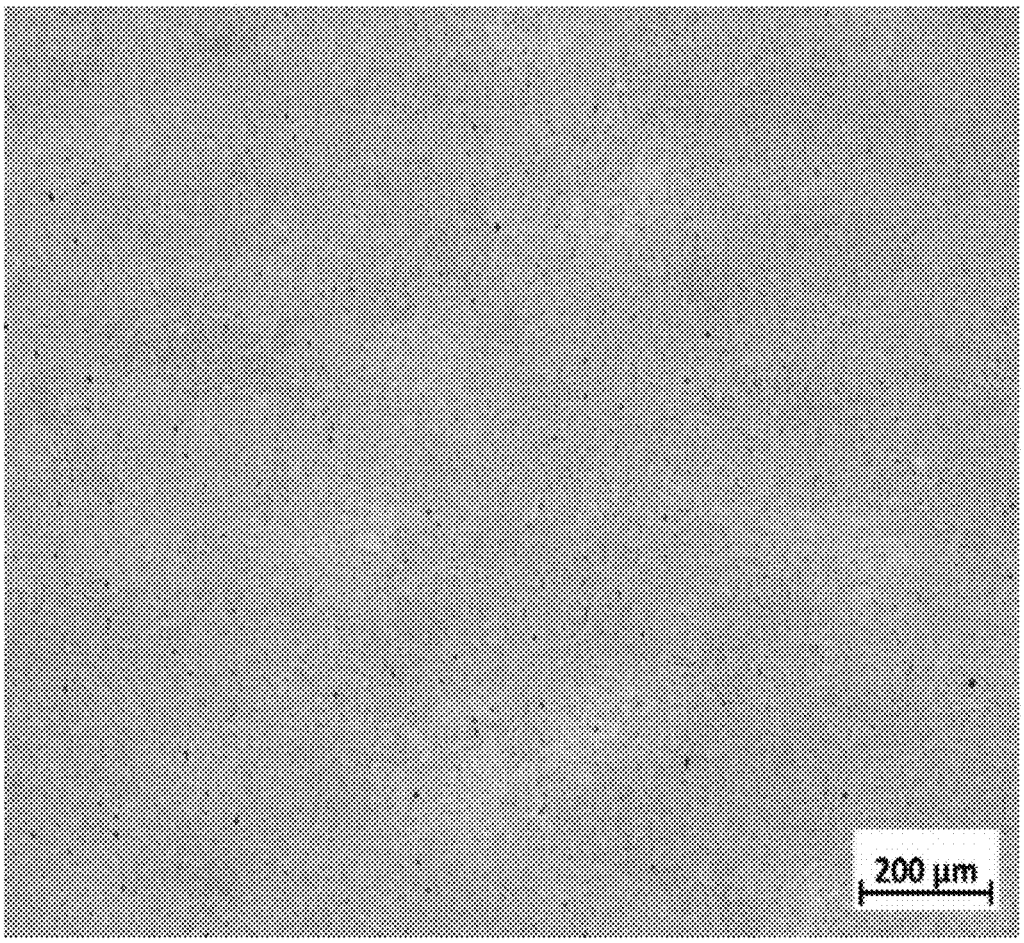
FIG. 1 is a metallographic structure diagram of rare earth die steel prepared in Example 1 of the present disclosure.

The present disclosure provides a rare earth die steel, including, by mass percentage, the following components: 0.36%-0.41% of C, 0.80%-1.10% of Si, 0.30%-0.50% of Mn, 4.90%-5.40% of Cr, 1.35%-1.55% of Mo, 0.8%-1.1% of V, 0.001%-0.005% of B, 0.006%-0.01% of Y, 0.001%-0.005% of Mg, no more than 0.003% of S, no more than 0.012% of P, no more than 0.0015% of O, less than 0.005% of H, and the balance Fe, where 0.01%<Y+Mg<0.02%.

The rare earth die steel according to the present disclosure includes, by mass percentage, 0.36%-0.41% of C, preferably 0.39%-0.41% of C. In the present disclosure, the C element is used as the basic element in the die steel, and a usage amount thereof is controlled within the foregoing range, which is beneficial to ensuring strength and toughness of the die steel and obtaining rare earth die steel with high impact toughness and high isotropy.

The rare earth die steel according to the present disclosure includes: by mass percentage, 0.80%-1.10% of Si, preferably 0.85%-0.95% of Si. In the present disclosure, the addition of the Si element improves the oxidation resistance of steel.

The rare earth die steel according to the present disclosure includes, by mass percentage, 0.30%-0.50% of Mn, preferably 0.38%-0.45% of Mn. In the present disclosure, the Mn element, together with Cr, Mo and Si, improves the hardenability of the die steel.

The rare earth die steel according to the present disclosure includes, by mass percentage, 4.90%-5.40% of Cr, preferably 4.98%-5.30% of Cr. In the present disclosure, the Cr element has a favorable influence on the toughness and hardenability of the die steel, and its dissolution into a matrix can significantly improve the corrosion resistance and oxidation resistance of the steel.

The rare earth die steel according to the present disclosure includes, by mass percentage, 1.35%-1.55% of Mo, preferably 1.48%-1.52% of Mo. In the present disclosure, the addition of the Mo element improves strength of the die steel.

The rare earth die steel according to the present disclosure includes, by mass percentage, 0.8%-1.1% of V, preferably 0.89%-0.95% of V. In the present disclosure, the V element plays a role in refining the structure and grains of the die steel, improves strength and toughness of the die steel, and is beneficial to obtaining rare earth die steel with high impact toughness and high isotropy.

The rare earth die steel according to the present disclosure includes, by mass percentage, 0.001%-0.005% of B, preferably 0.002%-0.004% of B. In the present disclosure, on the one hand, the B element can fill the grain boundary defects by adsorption on a grain boundary, reduce grain boundary energy, thus making new phase nucleation difficult and improving primary carbide segregation; and on the other hand, the B element can improve the hardenability of austenite, inhibit the formation of a non-martensite structure during cooling, and achieve the purpose of improving strength and toughness of die steel, thereby obtaining rare earth die steel with high impact toughness and high isotropy.

The rare earth die steel according to the present disclosure includes, by mass percentage, 0.006%-0.01% of Y, preferably 0.007%-0.009% of Y. In the present disclosure, the Y element, with a small atomic radius (1.801 Å) and a high melting point, is a surface active element, and has obvious microalloying effects such as Fe atomic replacement and grain boundary segregation. Besides, the density of $YO_xS_y$ composite inclusions formed by Y is about 4.25 g/cm$^3$. Based on a Stokes formula, a large-size yttrium-based oxysulfide is easier to float up during solidification, which provides conditions for the formation of submicron rare earth composite inclusions in hot working die steel and the refinement of high-temperature austenite grains, and also ensures the use of heterogeneous nucleation of primary carbides. In addition, the grain boundary occupation by rare earth Y inhibits the segregation of harmful elements (P, As, and Bi) at the grain boundaries, and also inhibits the enrichment of alloying element Cr at the grain boundaries, thereby reducing the endanger of cracking caused by band segregation of primary carbides at the grain boundaries, increasing strength and toughness of die steel, and facilitating the obtaining of rare earth die steel with high impact toughness and high isotropy.

The rare earth die steel according to the present disclosure includes, by mass percentage, 0.001%-0.005% of Mg, preferably 0.003%-0.004% of Mg. In the present disclosure, Mg and Y elements are easily combined with O and S to form composite inclusions, which can purify the matrix, and can form fine and uniformly dispersed sub-micron composite inclusions, which is extremely beneficial to playing the role of "oxide metallurgy". In addition, in the present disclosure, Y, Mg and B are added simultaneously to control the precipitation of primary carbides in the solidification process, so as to improve network segregation behavior of such carbides, thereby improving toughness and strength of rare earth die steel, and facilitating the obtaining of rare earth die steel with high impact toughness and high isotropy.

In the present disclosure, the total mass content of Y and Mg needs to meets 0.01%<Y+Mg<0.02%. In the present disclosure, the total mass content of Y and Mg is controlled within the foregoing range, which is beneficial to giving full play to functions of Mg and Y in matrix purification and oxide metallurgy.

The rare earth die steel according to the present disclosure includes, by mass percentage, no more than 0.003% of S, preferably no more than 0.002% of S. In the present disclosure, the content of the S element is controlled within the foregoing range, which is beneficial to obtaining rare earth die steel with high impact toughness and high isotropy.

The rare earth die steel according to the present disclosure includes, by mass percentage, no more than 0.012% of P, preferably no more than 0.01% of P. In the present disclosure, the content of the P element is controlled within the foregoing range, which is beneficial to obtaining rare earth die steel with high impact toughness and high isotropy.

The rare earth die steel according to the present disclosure includes, by mass percentage, no more than 0.0015% of O, preferably no more than 0.001% of O. In the present disclosure, the content of the O element is controlled within the foregoing range, which is beneficial to obtaining rare earth die steel with high impact toughness and high isotropy.

The rare earth die steel according to the present disclosure includes, by mass percentage, less than 0.005% of H, preferably less than 0.003% of H. In the present disclosure, the content of the H element is controlled within the foregoing range, which is beneficial to obtaining rare earth die steel with high impact toughness and high isotropy.

The rare earth die steel according to the present disclosure further includes, by mass percentage, the balance Fe except the foregoing elements. In the present disclosure, the iron is used as an alloy matrix.

In the present disclosure, the matrix structure of the rare earth die steel is preferably a martensite structure. In the present disclosure, the matrix structure of the rare earth die steel is the martensite structure, so that the die steel has good strength and toughness, which is beneficial to obtaining the rare earth die steel with high impact toughness and high isotropy.

In the present disclosure, a band segregation degree of the rare earth die steel is preferably level As1, and grades of A, B, C, D, and Ds inclusions in the rare earth die steel are preferably less than or equal to level 1. In the present disclosure, preferably, a band segregation degree and inclusion grade of the rare earth die steel are controlled within the foregoing range, which is beneficial to obtaining rare earth die steel with high impact toughness and high isotropy.

In the present disclosure, the rare earth die steel can be used for preparing hot extrusion dies, hot stamping dies, hot die-casting dies and large-size combined dies.

In the present disclosure, Mg and B elements are added on the basis of adding rare earth element Y, so that the rare earth element purifies a matrix, and grain boundary occupation by Mg and B is fully utilized to regulate grain network chromium carbides. In addition, the B element can fully improve hardenability of austenite and ensure that non-martensite such as bainite does not appear during the cooling process, and therefore rare earth die steel with high impact toughness and high isotropy is obtained.

The present disclosure further provides a method for preparing the rare earth die steel in the foregoing technical solution, including converter smelting, LF secondary refining, VD refining treatment, casting, electroslag remelting, homogenization treatment, hot forging, and heat treatment that are performed in sequence.

In the present disclosure, no special limitation is imposed on operations of the converter smelting, LF secondary refining, VD refining treatment, casting, electroslag remelting, homogenization treatment and hot forging, and a technical solution well known to a person skilled in the art may be used. In the present disclosure, the casting is preferably die casting or continuous casting. In the present disclosure, the hot forging is preferably multidirectional hot forging.

In the present disclosure, Y and Mg are preferably added in the VD refining process, and Y and Mg are preferably added in the form of an yttrium-magnesium master alloy. In the present disclosure, a mass content of Y in the yttrium-magnesium master alloy is preferably 30%, and a mass content of Mg is preferably 70%; and a solid dissolved oxygen content of the yttrium-magnesium master alloy is preferably less than or equal to 0.005%.

In the present disclosure, the yttrium-magnesium master alloy is preferably added in the form of an alloy wire. In the present disclosure, a diameter of the yttrium-magnesium master alloy wire is preferably 3-6 mm; and a wire feeding rate of the yttrium-magnesium master alloy wire is preferably 2-4 m/s.

In the present disclosure, the yttrium-magnesium master alloy wire is fed preferably under an argon atmosphere; a flow rate of argon is preferably 80-100 L/min during the wire feeding process and preferably 50-80 L/min after the wire feeding process is completed; and an argon blowing treatment is used in the whole process of the VD refining treatment.

In the present disclosure, no special limitation is imposed on the method of adding other raw materials, and a conventional adding method well known to a person skilled in the art may be used.

In the present disclosure, a cooling process after the hot forging specifically includes: performing air cooling to 650-750° C. and then performing water cooling for 4-6 min, then performing air cooling to 400-450° C. and then performing water cooling for 4-6 min, and finally performing air cooling to room temperature; preferably, performing air cooling to 700-750° C. and then performing water cooling for 4-5 min, then performing air cooling to 400-420° C. and then performing water cooling for 5-6 min, and finally performing air cooling to room temperature. In the present disclosure, preferably, a hot-forged high-temperature forging billet is cooled to room temperature by using a segmented cooling method of circulation cooling (air-cooling and water-cooling), which avoids the coarsening of primary carbides and inhibits the formation of the non-martensite structure, thereby improving impact toughness and isotropy of the rare earth die steel.

In the present disclosure, the heat treatment preferably includes a primary heat treatment and a secondary heat treatment.

In the present disclosure, the primary heat treatment preferably includes: heating a hot-forged forging billet to 650-750° C. and keeping the temperature for 1-2 h, then heating to 1060-1080° C. and keeping the temperature for 6-8 h, then performing air cooling to 840-860° C., then performing water cooling for 4-6 min, then performing air cooling for 4-6 min, then performing water cooling for 3-5 min, then performing air cooling to 350-450° C., and finally performing oil cooling to room temperature; preferably, keeping the temperature at 650-700° C. for 1-2 h, then heating to 1060-1070° C. and keeping the temperature for 6-8 h, then performing air cooling to 850-860° C., then performing water cooling for 4-6 min, performing air cooling for 4-6 min, then performing water cooling for 3-5 min, then performing air cooling to 380-450° C., and finally performing oil cooling to room temperature. In the present disclosure, the primary heat treatment is used for refining grains, reducing segregation and increasing impact toughness of the die steel. In the present disclosure, preferably, the temperature of the primary heat treatment is controlled within the foregoing range. An excessively high temperature makes grains coarse and leads to Widmannstatten structure defects, so that the toughness of the die steel becomes poor; while an excessively low temperature makes strength and toughness of the rare earth die steel excessively low.

In the present disclosure, the secondary heat treatment preferably includes: performing compression deformation on the rare earth die steel after the primary heat treatment, keeping the temperature at 800-900° C. for 8-10 h, then cooling to 740-760° C. and keeping the temperature for 9-11 h, then performing furnace cooling to 500-600° C. and performing oil cooling to room temperature; more preferably, keeping the temperature at 850-900° C. for 8-10 h, then cooling to 750-760° C. and keeping the temperature for 9-11 h, then performing furnace cooling to 550-600° C. and performing oil cooling to room temperature. In the present disclosure, the secondary heat treatment is beneficial to the full spheroidization and uniform distribution of primary carbides, and uniform precipitation of secondary carbides, thereby improving impact toughness and isotropy of the rare earth die steel.

In the present disclosure, a furnace is heated to 800-900° C. in advance, and then the rare earth die steel after compression deformation is placed in the furnace for heat preservation.

In the present disclosure, the deformation amount of the compression deformation is 5%-10%, more preferably 6%-10%; and the compression deformation is preferably performed once. In the present disclosure, the compression deformation is beneficial to increasing the impact toughness of the die steel.

In the present disclosure, the rare earth die steel is prepared through converter smelting, LF secondary refining, VD refining treatment, casting, electroslag remelting, homogenization treatment, hot forging, and heat treatment that are performed in sequence. A combination of subsection cooling after forging, ultra-refining subsection heating and cooling, and a small deformation process before spheroidizing annealing is put forward, and a "water-air-water" cooling regime is adopted to implement full spheroidization and uniform distribution of primary carbides, and uniform precipitation of secondary carbides, thereby eliminating network grain boundary carbides, and further obtaining the rare earth die steel with high impact toughness and high isotropy.

The technical solutions in the present disclosure are clearly and completely described below with reference to the embodiments of the present disclosure. Apparently, the described embodiments are merely some rather than all of the embodiments of the present disclosure. All other embodiments obtained by a person of ordinary skill in the art based on the embodiments of the present disclosure without creative efforts shall fall within the protection scope of the present disclosure.

EXAMPLE 1

Component (by mass percentage): C: 0.39%, Si: 0.85%, Mn: 0.38%, Cr: 4.98%, Mo: 1.48%, V: 0.89%, O: 0.0012%, S: 0.002%, P: 0.011%, H: 0.004%, Y: 0.009%, Mg: 0.003%, B: 0.003%, and the balance Fe.

Preparation Process:

(1) The converter smelting and LF secondary refining were conducted for component raw materials other than Y and Mg elements, then the VD refining treatment was conducted, meanwhile an yttrium-magnesium master alloy wire was added, and finally continuous casting was conducted to obtain a continuous casting billet, where a feed rate of the yttrium-magnesium master alloy wire was 3 m/s, a flow rate of argon during wire feeding was 80 L/min, a flow rate of argon after wire feeding was 50 L/min, and an argon blowing treatment was performed in the whole process; the mass content of Y in the yttrium-magnesium master alloy wire was 30%, and the mass content of Mg was 70%.

(2) The electroslag remelting treatment, homogenization treatment and multidirectional hot forging were conducted for the continuous casting billet to obtain hot-forged rare earth die steel.

(3) The hot-forged rare earth die steel was air-cooled to 750° C., then water-cooled for 4 min, then air-cooled to 400° C., then water-cooled for 5 min, and air-cooled to room temperature to obtain a forging billet.

(4) The forging billet was heated to 700° C. and the temperature was kept for 1 h, then heated to 1070° C. and the temperature was kept for 8 h, then air-cooled to 860° C., water-cooled for 5 min, then air-cooled for 4 min, then water-cooled for 4 min, finally air-cooled to 400° C., and then oil cooling was conducted to room temperature to obtain a homogenized forgoing billet.

(5) A 6% compression deformation was performed on the homogenized forgoing billet, then the homogenized forgoing billet was placed in the furnace, the furnace was heated to 850° C. in advance, the temperature was kept for 9 h, cooled to 750° C. and the temperature was kept for 10 h, and furnace was furnace cooled to 500° C. and then oil cooling was conducted to room temperature to obtain rare earth die steel.

EXAMPLE 2

This example was the same as Example 1 except in that the mass percentage of Y is 0.007%, the mass percentage of Mg is 0.004%, and the mass percentage of B is 0.004%.

EXAMPLE 3

This example was the same as Example 1 except in that the mass percentage of Y is 0.008%, the mass percentage of Mg is 0.003%, and the mass percentage of B is 0.002%.

COMPARATIVE EXAMPLE 1

Component (by mass percentage): C: 0.38%, Si: 0.98%, Mn: 0.40%, Cr: 4.99%, Mo: 1.51%, V: 1.0%, O: 0.0015%, S: 0.003%, P: 0.011%, H: 0.004%, Y: 0.008%, and the balance Fe.

This preparation method was the same as that of Example 1.

COMPARATIVE EXAMPLE 2

Component (by mass percentage): C: 0.37%, Si: 0.91%, Mn: 0.41%, Cr: 5.01%, Mo: 1.49%, V: 0.99%, O: 0.0013%, S: 0.002%, P: 0.012%, H: 0.004%, Y: 0.009%, Mg: 0.004%, and the balance Fe.

This preparation method was the same as that of Example 1.

COMPARATIVE EXAMPLE 3

Component (by mass percentage): C: 0.37%, Si: 0.91%, Mn: 0.41%, Cr: 5.01%, Mo: 1.49%, V: 0.99%, O: 0.0013%, S: 0.002%, P: 0.012%, H: 0.004%, Y: 0.05%, Mg: 0.003%, B: 0.004%, and the balance Fe.

This preparation method was the same as that of Example 1.

COMPARATIVE EXAMPLE 4

Components of this example were the same as those of Example 1.

Preparation process:

(1) A converter plus secondary refining (LF+VD) was adopted, with an yttrium-magnesium master alloy wire added during VD refining treatment, where a wire feed rate was 3 m/s, and an argon blowing treatment was adopted in the entire process to obtain a continuous casting billet, where the flow rate of argon was preferably 80 L/min during wire feeding and 50 L/min after wire feeding.

(2) The continuous casting billet was conducted with electroslag remelting treatment, homogenization treatment and multidirectional hot forging, and then air-cooled to room temperature to obtain a forging billet.

(3) The forging billet was heated to 1070° C. and the temperature was kept for 8 h, and then air-cooled to room temperature to obtain a homogenized forging billet.

(4) A 6% compression deformation was performed on the homogenized forgoing billet, then the homogenized forgoing billet was placed in the furnace, the furnace was heated to 850° C. in advance, the temperature was kept for 9 h, and then the furnace was furnace cooled to room temperature to obtain rare earth die steel.

COMPARATIVE EXAMPLE 5

This example differs from Example 1 in that no 6% compression deformation was performed.

Properties of rare earth die steel prepared in Examples 1 to 3 and Comparative Examples 1 to 5 were tested. Test results are shown in Table 1.

Table 1 Properties of rare earth die steel prepared in Examples 1 to 3 and Comparative Examples 1 to 5

| No. | Y/% | Mg/% | B/% | Band segregation degree | Inclusion level | Longitudinal impact energy/J | Transverse impact energy/J | Isotropy |
|---|---|---|---|---|---|---|---|---|
| Example 1 | 0.009 | 0.003 | 0.003 | As1 | 1 | 16.2 | 14.4 | 0.88 |
| Example 2 | 0.007 | 0.004 | 0.004 | As1 | 1 | 15.9 | 13.5 | 0.85 |
| Example 3 | 0.008 | 0.003 | 0.002 | As1 | 1 | 16.1 | 13.9 | 0.86 |
| Comparative Example 1 | 0.008 | 0 | 0 | As5 | 2 | 13.1 | 10.03 | 0.77 |
| Comparative Example 2 | 0.009 | 0.004 | 0 | As2 | 1 | 9.25 | 7.08 | 0.77 |
| Comparative Example 3 | 0.05 | 0.003 | 0.004 | As2 | 3 | 8.23 | 6.80 | 0.83 |
| Comparative Example 4 | 0.009 | 0.003 | 0.003 | As5 | 1 | 8.44 | 5.55 | 0.66 |
| Comparative Example 5 | 0.009 | 0.003 | 0.003 | As2 | 1 | 10.11 | 8.55 | 0.85 |

It can be seen from Table 1 that the rare earth die steel prepared in Examples 1 to 3 of the present disclosure have higher band segregation and inclusion level, and have high isotropy and high strength and toughness. In Comparative Example 1, rare earth element Y was added, but without the addition of Mg and B, the banded structure of the die steel was just level As5, which was difficult to meet requirements of North American standards. In Comparative Example 2, No B element was added, although the band structure was improved, the impact toughness of the die steel decreased obviously due to the decrease of hardenability. In Comparative Example 3, the mass content of Y increased to 0.05%, which led to agglomeration of rare earth inclusions, resulting in the decrease of impact toughness of the die steel. In Comparative Example 4, a conventional primary heating and slow cooling system increased the band segregation degree of the die steel (As5), resulting in a significant decrease in impact toughness. In Comparative Example 5, the compression deformation with a small deformation amount was not performed, so that an impact toughness value was not high.

FIG. 1 is a metallographic structure diagram of rare earth die steel prepared in Example 1. It can be seen from FIG. 1 that a band segregation degree of the prepared rare earth die steel reaches level As1.

Figure 2:
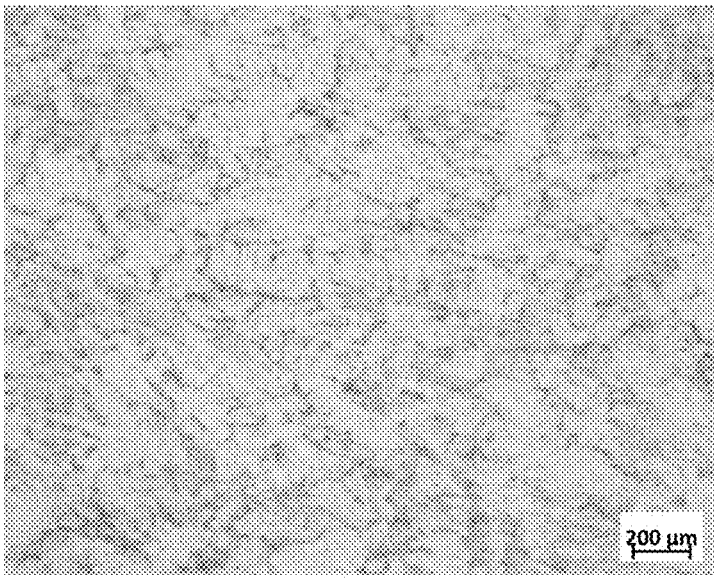
FIG. 2 is a metallographic structure diagram of die steel prepared in Comparative Example 1.

FIG. 2 is a metallographic structure diagram of die steel prepared in Comparative Example 1. It can be seen from FIG. 2 that in Comparative Example 1, although rare earth element Y was added, without the addition of Mg and B elements, the band structure was just level As5, which is difficult to meet requirements of North American standards.

Figure 3:
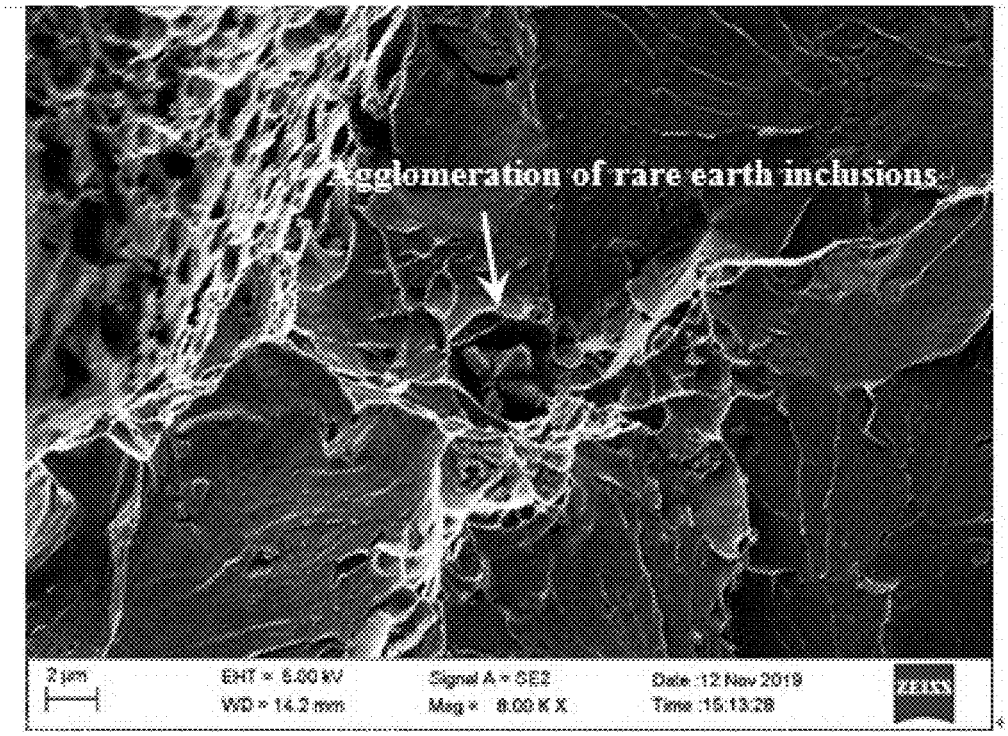
FIG. 3 is a scanning structure diagram of a longitudinal impact fracture of die steel prepared in Comparative Example 3.

FIG. 3 is a scanning structure diagram of a longitudinal impact fracture of die steel prepared in Comparative Example 3. It can be seen from FIG. 3 that the mass content of Y increased to 0.05%, which resulted in agglomeration of rare earth inclusions, and resulted in the decrease of impact toughness of the die steel.

Figure 4:
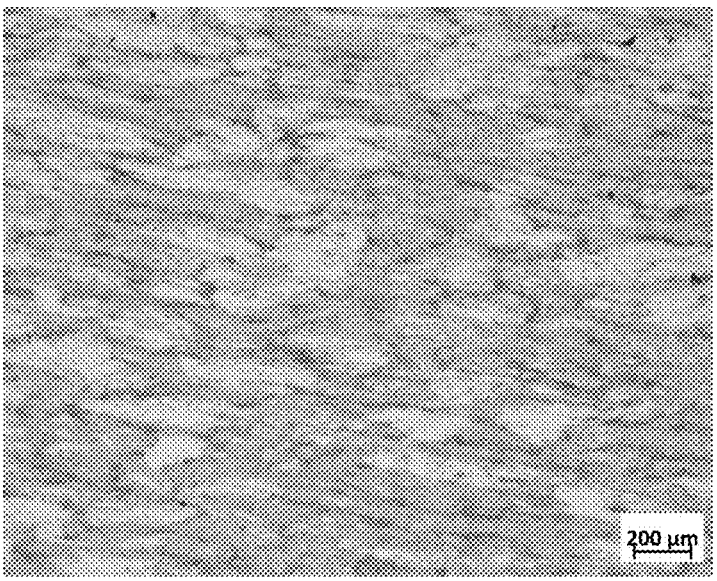
FIG. 4 is a metallographic structure diagram of die steel prepared in Comparative Example 4.

FIG. 4 is a metallographic structure diagram of die steel prepared in Comparative Example 4. It can be seen from FIG. 4 that the conventional primary heating and slow cooling system increased a band segregation degree of the die steel (As5), which led to a significant decrease in impact toughness.

It can be learned from the foregoing examples that the rare earth die steel according to the present disclosure has excellent impact toughness and strength. The band segregation degree of the prepared rare earth die steel is As1, the inclusion level is level 1, longitudinal impact energy is 16.2 J, transverse impact energy is 14.4 J, and the isotropy is 0.88.

The above described are only preferred implementations of the present disclosure. It should be noted that for a person of ordinary skill in the art, several improvements and polishing may also be made without departing from the principle of the present disclosure, and the improvements and polishing should also be regarded as falling within the protection scope of the present disclosure.

What is claimed is:

1. A method for preparing a rare earth die steel, comprising converter smelting, LF secondary refining, VD refining treatment, casting, electroslag remelting, homogenization treatment, hot forging, and heat treatment performed in sequence, wherein the rare earth die steel comprises, by mass percentage, the following components: 0.36%-0.41% of C, 0.80%-1.10% of Si, 0.30%-0.50% of Mn, 4.90%-5.40% of Cr, 1.35%-1.55% of Mo, 0.8%-1.1% of V, 0.001%-0.005% of B, 0.006%-0.01% of Y, 0.001%-0.005% of Mg, no more than 0.003% of S, no more than 0.012% of P, no more than 0.0015% of O, less than 0.005% of H, and the balance of Fe, wherein 0.01%<Y+Mg<0.02%.

2. The method according to claim 1, wherein Y and Mg are added in the VD refining treatment process, and Y and Mg are added in the form of an yttrium-magnesium master alloy; and a mass content of Y in the yttrium-magnesium master alloy is 30%, and a mass content of Mg is 70%.

3. The method according to claim 2, wherein the yttrium-magnesium master alloy is added in the form of an alloy wire; a diameter of the yttrium-magnesium master alloy wire is 3-6 mm; and a wire feeding rate of the yttrium-magnesium master alloy wire is 2-4 m/s.

4. The method according to claim 3, wherein the yttrium-magnesium master alloy wire is fed under an argon atmosphere; a flow rate of argon is 80-100 L/min during the wire feeding and 50-80 L/min after the wire feeding is completed; and an argon blowing treatment is used throughout the VD refining treatment.

5. The method according to claim 1, wherein a cooling process after the hot forging comprises: air-cooling to 650-750° C. and then water-cooling for 4-6 min, then air-cooling to 400-450° C. and then water-cooling for 4-6 min, and finally air-cooling to room temperature.

6. The method according to claim 1, wherein the heat treatment comprises a primary heat treatment and a secondary heat treatment;

the primary heat treatment comprises: heating a forging billet obtained from the hot forging to a temperature of 650-750° C. and keeping at the temperature for 1-2 h, then heating to a temperature of 1060-1080° C. and keeping at the temperature for 6-8 h, then air-cooling to 840-860° C., then water-cooling for 4-6 min, then air cooling for 4-6 min, then water cooling for 3-5 min, then air-cooling to 350-450° C., and finally oil-cooling to room temperature; and the secondary heat treatment comprises: performing compression deformation on the rare earth die steel after the primary heat treatment, then keeping at 800-900° C. for 8-10 h, then cooling to a temperature of 740-760° C. and keeping at the temperature for 9-11 h, then furnace-cooling to 500-600° C., and oil-cooling to room temperature.

7. The method according to claim 6, wherein a deformation amount of the compression deformation is 5-10%.

8. The method according to claim 1, wherein the rare earth die steel comprises, by mass percentage, 0.39%-0.41% of C, 0.85%-0.95% of Si, 0.38%-0.45% of Mn, 4.98%-5.30% of Cr, 1.48%-1.52% of Mo, 0.89%-0.95% of V, 0.002%-0.004% of B, 0.007%-0.009% of Y, 0.003%-0.004% of Mg, no more than 0.003% of S, no more than 0.012% of P, no more than 0.0015% of O, less than 0.005% of H, and the balance of Fe, wherein 0.01%<Y+Mg<0.02%.

9. The method according to claim 1, wherein a band segregation degree of the rare earth die steel is level Asl, and grades of A, B, C, D, and Ds inclusions in the rare earth die steel are less than or equal to level 1.

* * * * *